US009745875B2

(12) United States Patent
Yano et al.

(10) Patent No.: US 9,745,875 B2
(45) Date of Patent: Aug. 29, 2017

(54) VARIABLE VALVE GEAR FOR INTERNAL COMBUSTION ENGINE

(75) Inventors: Toshiyuki Yano, Gotemba (JP); Yoshiaki Miyazato, Sunto-gun (JP); Motohiro Yuge, Susono (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 177 days.

(21) Appl. No.: 14/422,501

(22) PCT Filed: Aug. 22, 2012

(86) PCT No.: PCT/JP2012/071186

§ 371 (c)(1),
(2), (4) Date: Feb. 19, 2015

(87) PCT Pub. No.: WO2014/030226

PCT Pub. Date: Feb. 27, 2014

(65) Prior Publication Data

US 2015/0184560 A1 Jul. 2, 2015

(51) Int. Cl.

| | |
|---|---|
| ***F01L 1/34*** | (2006.01) |
| ***F01L 13/00*** | (2006.01) |
| ***F01L 1/08*** | (2006.01) |
| ***F01L 1/26*** | (2006.01) |
| *F01L 1/18* | (2006.01) |
| *F01L 1/24* | (2006.01) |
| *F01L 1/047* | (2006.01) |

(52) U.S. Cl.

CPC ..... *F01L 13/0057* (2013.01); *F01L 1/08* (2013.01); *F01L 1/267* (2013.01); *F01L 13/0005* (2013.01); *F01L 1/185* (2013.01); *F01L 1/2405* (2013.01); *F01L 2001/0473* (2013.01); *F01L 2820/035* (2013.01)

(58) Field of Classification Search

CPC ... F01L 1/08; F01L 1/185; F01L 1/267; F01L 1/2405; F01L 13/0057; F01L 2001/0473

USPC ..... 123/90.16, 90.6, 90.39, 90.44

See application file for complete search history.

(56) References Cited

U.S. PATENT DOCUMENTS

| | | | | |
|---|---|---|---|---|
| 6,427,653 | B1 | 8/2002 | Hara et al. | |
| 7,069,889 | B2 * | 7/2006 | Lechner | F01L 1/08 123/90.16 |
| 2006/0011161 | A1 | 1/2006 | Lechner et al. | |

FOREIGN PATENT DOCUMENTS

| | | | |
|---|---|---|---|
| DE | 10038916 | A1 | 2/2002 |
| GB | 2427897 | A | 1/2007 |

(Continued)

*Primary Examiner* — Ching Chang

(74) *Attorney, Agent, or Firm* — Andrews Kurth Kenyon LLP

(57) ABSTRACT

A variable valve gear for an internal combustion engine includes: a cam base portion integrally or separately provided in a camshaft, and immovably fixed to the camshaft; a cam lobe portion connected to the cam base portion so as to swing and shift between a first state where the cam lobe portion is positioned to project from an outer circumference of the base portion and a second state where the cam lobe portion is positioned to be lower than the cam base portion in the first state; a lock mechanism locking the cam lobe portion in the first and second state; and a biasing member biasing the cam lobe portion to be shifted to the first state, to such an extent that the cam lobe portion is shifted to the second state by reaction force from a cam follower when the locking mechanism is unlocked.

8 Claims, 9 Drawing Sheets

(56) References Cited

FOREIGN PATENT DOCUMENTS

| | | | |
|---|---|---|---|
| JP | S60-8402 | U | 1/1985 |
| JP | S62-195608 | U | 12/1987 |
| JP | 2001-329819 | A | 11/2001 |
| JP | 2006-526727 | A | 11/2006 |
| WO | 2004109068 | A1 | 12/2004 |

* cited by examiner

VARIABLE VALVE GEAR FOR INTERNAL COMBUSTION ENGINE

CROSS-REFERENCE TO RELATED APPLICATION

This is a national phase application based on the PCT International Patent Application No. PCT/JP2012/071186 filed Aug. 22, 2012, the entire contents of which are incorporated herein by reference.

TECHNICAL FIELD

The present invention is related to a variable valve gear for an internal combustion engine.

BACKGROUND ART

Patent Document 1 discloses a variable valve gear for an internal combustion engine equipped with a camshaft and a cam piece through which the camshaft penetrates.

PRIOR ART DOCUMENT

Patent Document

Patent Document 1: Japanese Patent Application Publication No. 2001-329819

SUMMARY OF THE INVENTION

Problems to be Solved by the Invention

A hole of the cam piece through which the camshaft penetrates is designed to have a size to allow the cam piece to move in the radial direction. Thus, the cam piece might have a small axial cross-sectional area, so that the cam piece might not ensure its strength. Further, the camshaft penetrates through the cam piece, so the camshaft has to be thin to some extent. Furthermore, a pin and a biasing member are arranged within the camshaft. Therefore, the camshaft might also not ensure its strength.

It is thus an object of the present invention to provide a variable valve gear for an internal combustion engine ensuring strength.

Means for Solving the Problems

The above object is achieved by a variable valve gear for an internal combustion engine, including: a cam base portion integrally or separately provided in a camshaft, and immovably fixed to the camshaft; a cam lobe portion connected to the cam base portion so as to swing and shift between a first state where the cam lobe portion is positioned to project from an outer circumference of the base portion and a second state where the cam lobe portion is positioned to be lower than the cam base portion in the first state; a lock mechanism locking the cam lobe portion in the first and second state; and a biasing member biasing the cam lobe portion to be shifted to the first state, to such an extent that the cam lobe portion is shifted to the second state by reaction force from a cam follower when the locking mechanism is unlocked.

The locking mechanism may include: a locking member held in a holding hole, of the cam lobe portion, extending in an axial direction of the camshaft; a first locking hole formed in the cam base portion, and arranged in the axial direction in the first state; a second locking hole formed in the cam base portion, and arranged in the axial direction in the second state; a first spring biasing the locking member to be inserted into the first locking hole in the first state; a second spring biasing the locking member to recede from the second locking hole in the second state; a first path formed in the cam base portion, and is configured to exert a hydraulic pressure on the locking member to be disengaged from the first locking hole in the first state; and a second path formed in the cam base portion, and is configured to exert a hydraulic pressure on the locking member to be inserted into the second locking hole in the second state.

The second path may include an outlet that is spaced apart from the cam lobe portion in the first state, and that discharges oil to an outside of the cam base portion.

A hydraulic control valve adjusting a hydraulic pressure to be supplied to the first and second paths; and a control unit learning a hydraulic pressure when the first state is shifted to the second state may be included.

The control unit may perform control to learn a hydraulic pressure while fuel cut is performed in the internal combustion engine.

The cam base portion may include a retaining portion that retains the oil in contact with the cam lobe portion in the second state.

The cam lobe portion may include: a proximal end portion swingably connected to the cam base portion; and a free end portion spaced apart from the proximal end portion in a direction opposite to a rotational direction of the camshaft.

The biasing member may be arranged in an axial direction of the camshaft with respect to the cam lobe portion.

The cam lobe portion may include first and second cam lobe portions arranged in an axial direction of the camshaft; and the cam base portion may support the first and second cam lobe portions.

Effects of the Invention

It is possible to provide a variable valve gear for an internal combustion engine ensuring strength.

MODES FOR CARRYING OUT THE INVENTION

In the following, an embodiment will be described in detail with reference to the accompanying drawings.

Figure 1:
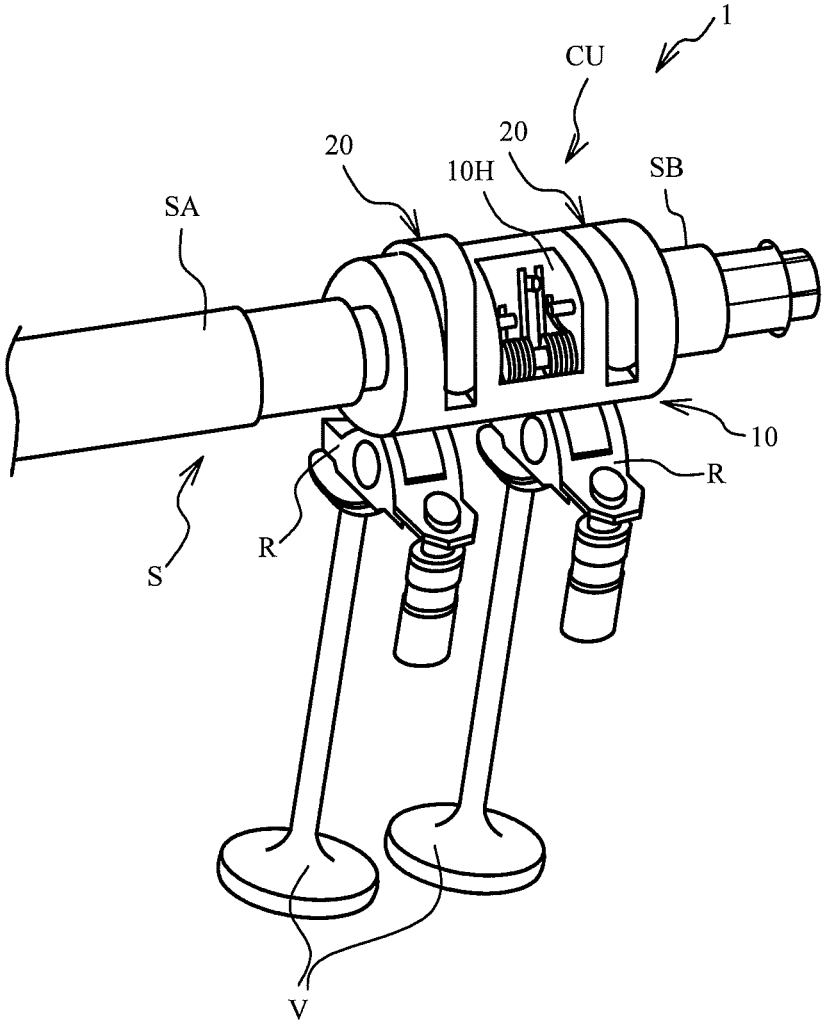
FIG. 1 is an external view of a variable valve gear according to a present embodiment.

FIG. 1 is an explanatory view of a variable valve gear 1 according to the present embodiment. The variable valve gear 1 is installed in an internal combustion engine mounted on a vehicle or the like. The variable valve gear 1 includes a camshaft S and a cam unit CU provided on the camshaft S. The camshaft S includes a portion SA connected to one end of the cam unit CU and a portion SB connected to the other end of the cam unit CU. The camshaft S is rotated by the drive force from the internal combustion engine. The rotation of the cam unit CU with the camshaft S lift valves V through rocker arms R. The valve V is an intake valve or an exhaust valve of an internal combustion engine.

The cam unit CU includes: a cam base portion 10 having a diameter greater than a diameter of the camshaft S and connected to the portions SA and SB; and two cam lobe portions 20 connected to the cam base portion 10. The cam base portion 10 has a substantially cylindrical shape, and includes a base circle portion 11 having a substantially circular shape when viewed in the axial direction of the camshaft S (hereinafter referred to as axial direction). The base circle portion 11 corresponds to the outer circumferential surface of the cam base portion 10. The two cam lobe portions 20 are arranged at a predetermined interval in the axial direction. The two cam lobe portions 20 push two rocker arms R to lift the valves V, respectively. The axial thickness of the cam base portion 10 is greater than that of the cam lobe portion 20.

Figure 2:
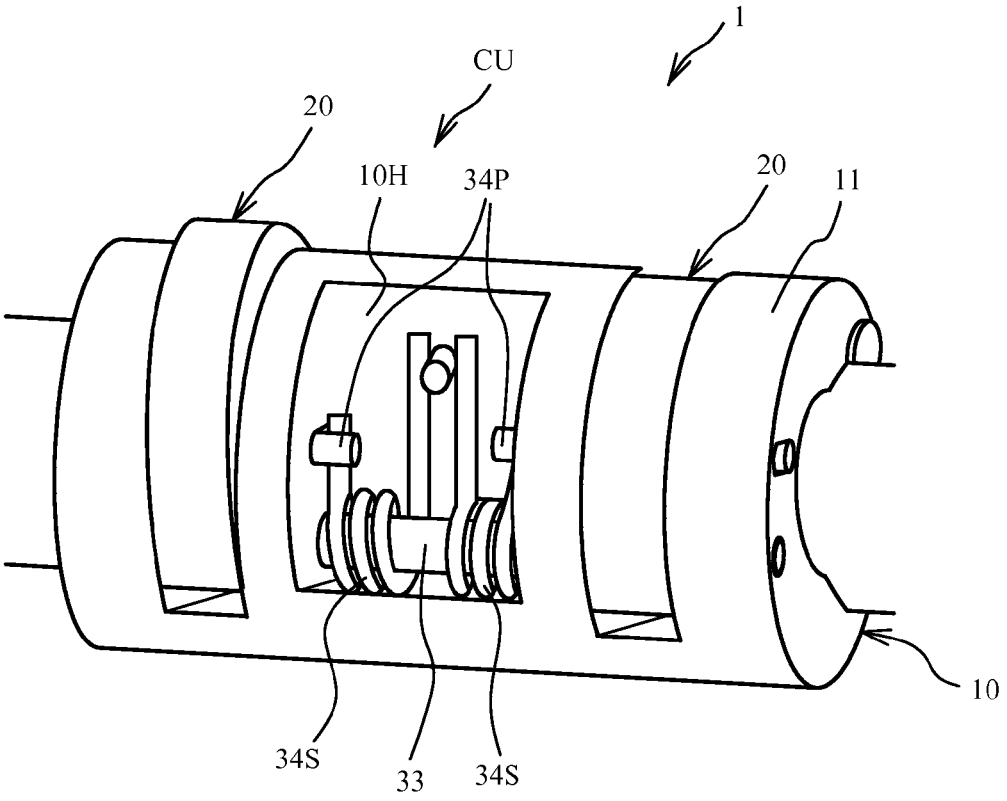
FIG. 2 is an external view of the variable valve gear according to the present embodiment.

As illustrated in FIG. 2, the cam base portion 10 is provided with a recess portion 10H between the two cam lobe portions 20. The recess portion 10H is formed between portions of the cam base portion 10 that comes into contact with the two rocker arms R. The recess portion 10H does not come into contact with the rocker arm R. A support shaft 33 penetrates through the cam base portion 10 and the two cam lobe portions 20. The cam lobe portion 20 swings about the support shaft 33 with respect to the cam base portion 10. A part of the support shaft 33 is exposed in the recess portion 10H. Two stopper pins 34P penetrate through the two cam lobe portions 20, respectively.

In the recess portion 10H of the cam base portion 10, two spring 34S are respectively wound around the support shafts 33. One end of the spring 34S pushes an inner surface of the recess portion 10H, and the other end of the spring 34S pushes the stopper pin 34P. That is, the spring 34S biases the stopper pin 34P away from the recess portion 10H. Thus, the cam lobe portion 20 is biased to project from the cam base portion 10. The spring 34S is an example of a biasing member.

In FIGS. 1 and 2, the cam lobe portion 20 illustrated in the left side is in the lift state of projecting from the base circle portion 11 of the cam base portion 10, and the cam lobe portion 20 illustrated in the right side is in the lift stop state of not projecting from the base circle portion 11 of the cam base portion 10. In the lift state, the cam lobe portion 20 drives the rocker arm R to lift the valve V. In the lift stop state, the cam lobe portion 20 comes into contact with or does not come into contact with the rocker arm R, so the valve V is not lifted. The lift state is an example of a first state, and the lift stop state is an example of a second state. Additionally, in FIGS. 1 and 2, to facilitate understanding, only one of the cam lobe portions 20 is in the lift state. Actually, the two cam lobe portions 20 are brought into the same state as will be described later.

Figure 3A:
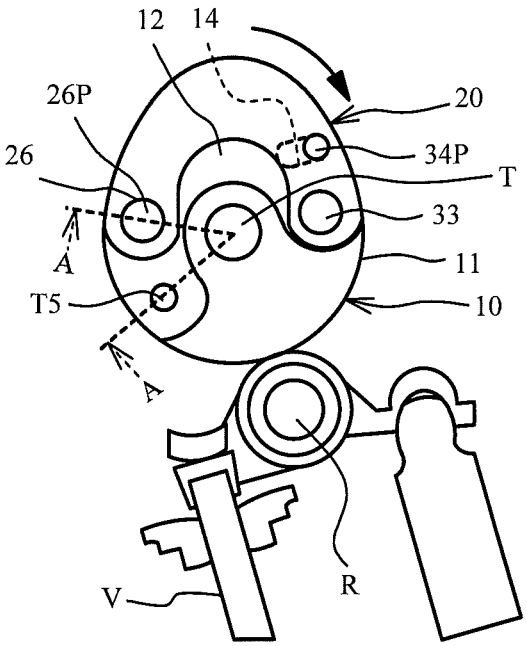
FIGS. 3A and 3B are sectional views of the cam unit when viewed in the axial direction.
Figure 3B:
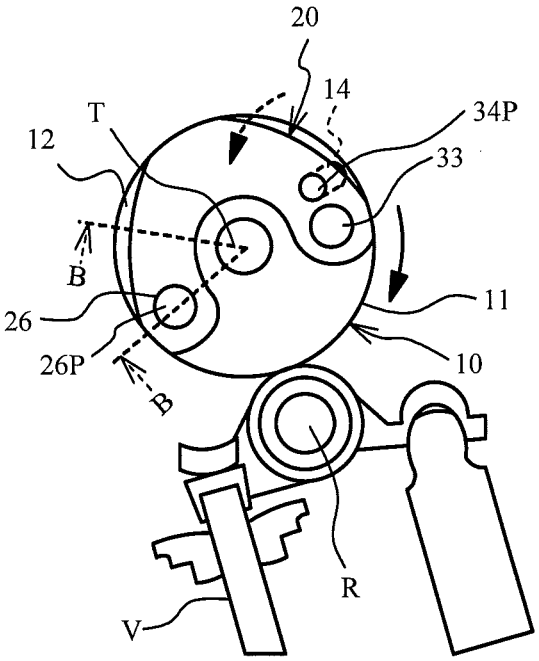

FIGS. 3A and 3B are sectional views of the cam unit CU viewed in the axial direction. FIG. 3A illustrates the cam lobe portion 20 in the lift state, and FIG. 3B illustrates the cam lobe portion 20 in the lift stop state. The cam lobe portion 20 is formed into a substantially U-shape or substantially L-shape so as to be spaced apart from a supply path T of the cam base portion 10. The support shaft 33 penetrates through the proximal end side of the cam lobe portion 20. In FIGS. 3A and 3B, the camshaft S rotates clockwise. In response to this, the cam base portion 10 and the cam lobe portion 20 also rotate clockwise. The cam base portion 10 is provided with an oblong hole 14 through which the stopper pin 34P penetrates. The oblong hole 14 restricts the movable range of the stopper pin 34P that is moved by the swing of the cam lobe portion 20, thereby restricting the swinging range of the cam lobe portion 20.

Figure 4A:
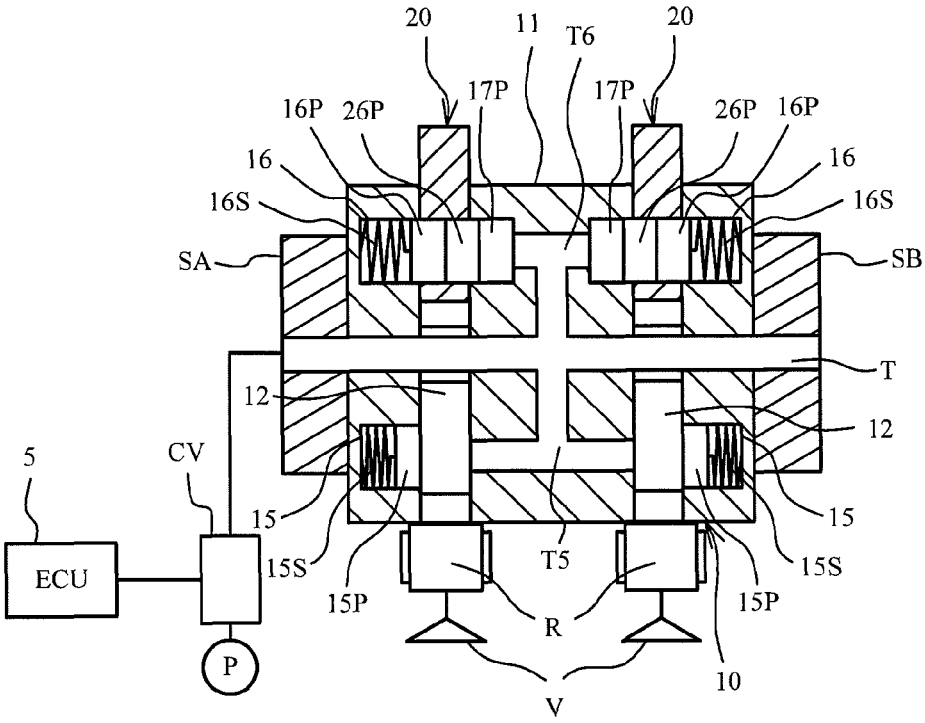
FIGS. 4A and 4B are sectional views illustrating internal structure of a cam unit.
Figure 4B:
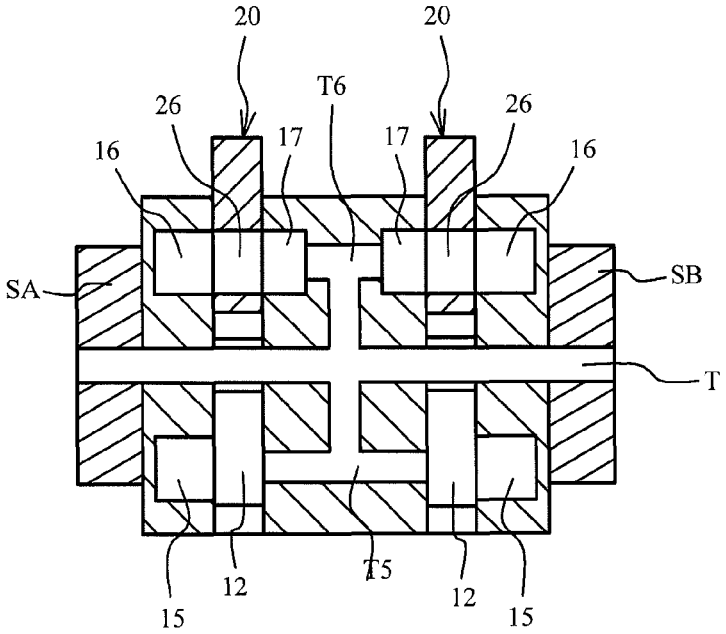

FIGS. 4A and 4B are sectional views illustrating the internal structure of the cam unit CU. In FIGS. 4A and 4B, both cam lobe portions 20 are in the lift state. FIGS. 4A and 4B correspond to views taken along line A-A of FIG. 3A. As illustrated in FIGS. 4A and 4B, the cam unit CU is symmetrically formed with respect to the center of the cam unit CU in the axial direction. Therefore, one of the cam lobe portions 20 will be described below. The cam base portion 10 is provided with a slit 12 capable of housing the cam lobe portion 20. Within the cam base portion 10, there are provided the supply path T that extends coaxially with the camshaft S, and paths T5 and T6 that extends radially outward from the supply path T. The paths T5 and T6 extend radially outward from the supply path T, and respective extend toward the two cam lobe sides in the axial direction. The path T6 is an example of a first path. The path T5 is an example of a second path.

An oil control valve CV is a flow control valve of an electromagnetic drive type controlled by an ECU 5. The ECU 5 is an example of a control unit. Oil stored in an oil pan is supplied to the supply path T by an oil pump P. The oil pump P is a mechanical type linked to the crankshaft of the internal combustion engine. The oil control valve CV is capable of linearly adjusting the hydraulic pressure supplied to the supply path T by the oil pump P, on the basis of the current value applied to the oil control valve CV. The oil control valve CV is an example of a hydraulic control valve. Also, the hydraulic control valve may adjust the hydraulic pressure supplied to the supply path T in a stepwise manner. The ECU 5 includes a CPU, a ROM, and a RAM, and controls the whole operation of the internal combustion engine. In the ROM, a program for performing the control that will be described later is stored.

The cam base portion 10 holds pins 15P, 16P, and 17P acting on each of the two cam lobe portions 20. Each of the two cam lobe portions 20 holds a pin 26P. The pin 26P is an example of a locking member. In FIG. 4B, the pin 15P and the like are omitted. The cam lobe portion 20 includes a free end spaced apart from the proximal end through which the support shaft 33 penetrates, and the cam lobe portion 20 is provided in its free end side with a hole 26 holding the pins 26P. The hole 26 extends through the cam lobe portion 20 in the axial direction. The hole 26 is an example of a holding hole.

The cam base portion 10 is provided with holes 15 and 16 communicating with the slit 12. The holes 15 and 16 are formed on the same side of the slit 12. The holes 15 and 16 extend in the axial direction and each have a bottom surface. The holes 15 and 16 respectively house the pins 15P and 16P. A spring 15S connected to the pin 15P is disposed between the pin 15P and the bottom surface of the hole 15. A spring 16S connected to the pin 16P is disposed between the pin 16P and the bottom surface of the hole 16. The spring 16S biases the pin 16P toward the cam lobe portion 20. The length of the spring 15S is designed to such an extent the pin 15P is not disengaged from the hole 15. The spring 15S is an example of a second spring. The spring 16S is an example of the first spring.

The cam base portion 10 is provided with a hole 17 facing the hole 16 across the slit 12. The hole 17 houses the pin 17P. The hole 17 is communicated to the path T6. The hole 17 is positioned coaxially with the hole 16. The hole 17 extends in the axial direction.

In the lift state, the holes 16, 17, and 26 are aligned in the axial direction, and the pins 16P, 17P, and 26P are aligned in the axial direction. In other words, in order to match a position where the cam lobe portion 20 is located at one end of the swinging range thereof with such an above position, the swinging range of the cam lobe portion 20 is defined by the oblong hole 14 engaged with the stopper pin 34P. In the lift state, the pin 16P is commonly inserted into the holes 16 and 26 by the biasing force of the spring 16S, and the pin 26P is commonly inserted into the holes 26 and 17. Thus, the cam lobe portion 20 is locked to the cam base portion 10 in the lift state. The hole 17 is an example of a first locking hole.

Figure 5A:
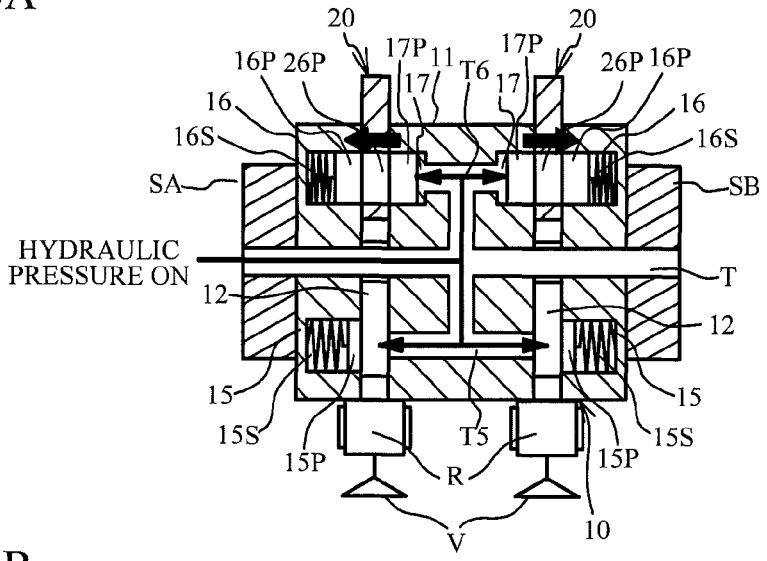
FIGS. 5A to 5C are explanatory views of locking of a cam lobe portion.

Next, the locking of the cam lobe portion 20 will be described in detail. FIGS. 5A to 6B are explanatory views of the locking of the cam lobe portion 20. Oil is supplied to paths T5 and T6 from the supply path T by the oil pump P and the oil control valve CV, so that the pin 17P is pushed toward the cam lobe portion 20 against the biasing force of the spring 16S as illustrated in FIG. 5A. As a result, the pin 16P is disengaged from the holes 26, and the pin 26P is disengaged from the hole 17. In other words, the pins 16P, 17P, and 26P are housed in the holes 16, 17, and 26, respectively. Accordingly, the locking of the cam lobe portion 20 in the lift state is released.

Figure 5B:
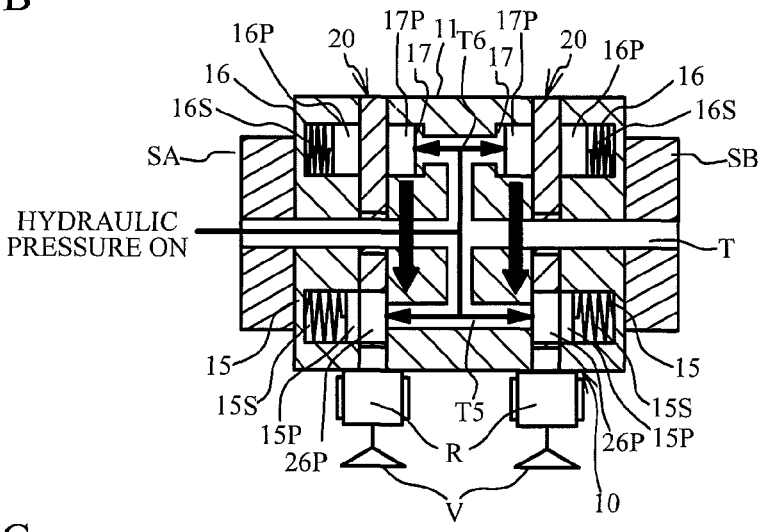

The camshaft S rotates in the state where the locking of the cam lobe portion 20 is released, so the cam lobe portion 20 receives a reaction force from the rocker arm R. Thus, as illustrated in FIG. 5B, the cam lobe portion 20 is moved to such a position as not to project from the cam base portion 10 against the biasing force of the spring 34S. Therefore, the cam lobe portion 20 is brought into the lift stop state. In other words, the biasing force of the spring 34S is designed to such an extent that the cam lobe portion 20 can be brought into the lift stop state by the reaction force from the rocker arm R in the state where the locking of the cam lobe portion 20 is released. In the lift stop state, the holes 15 and 26 are coaxially aligned. In other words, in order to match a position where the cam lobe portion 20 is located at the other end of the swinging range thereof with such an above position, the swinging range of the cam lobe portion 20 is defined by the oblong hole 14 engaged with the stopper pin 34P. The rocker arm R is an example of a cam follower for driving the valve. The cam follower may be a valve lifter that is directly driven by the cam.

Figure 5C:
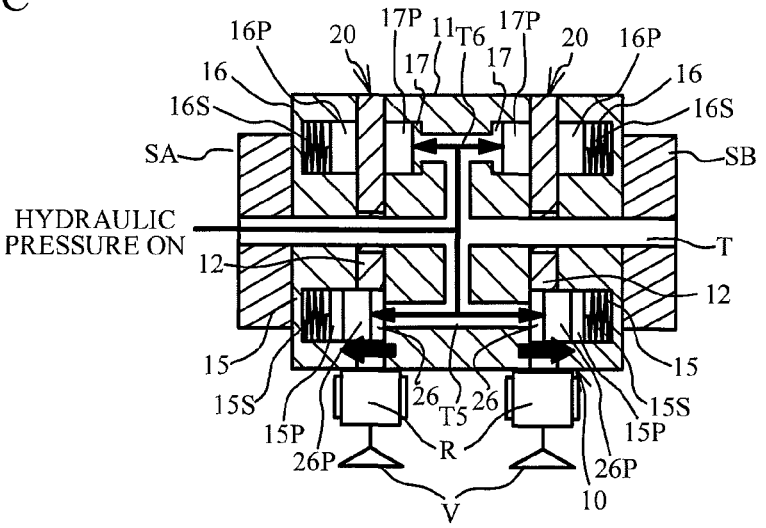

The pin 26P is commonly inserted to the holes 15 and 26 by the pressure of oil from the path T5, as illustrated in FIG. 5C, against the biasing force of the spring 15S. Thus, the cam lobe portion 20 is locked in the lift stop state. In such a way, while oil is supplied to the supply path T at a pressure higher than a predetermined pressure, the cam lobe portion 20 is locked in the lift stop state. The hole 15 is an example of a second locking hole.

Figure 6A:
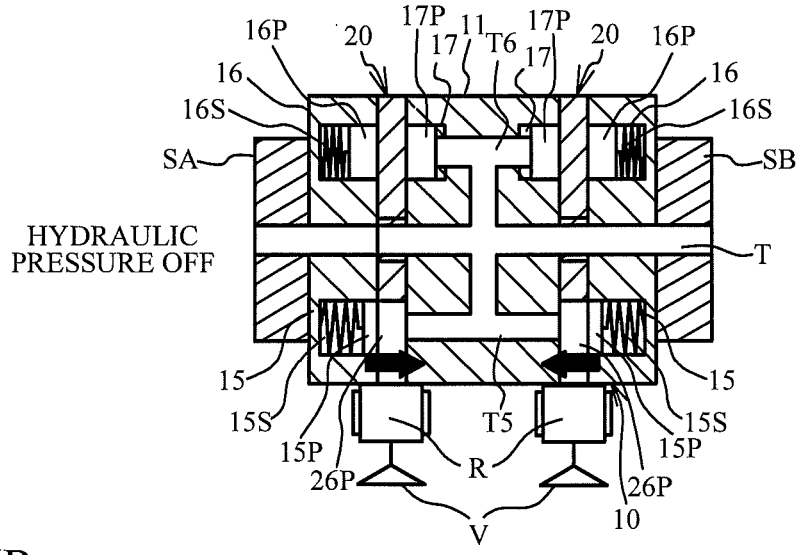
FIGS. 6A and 6B are explanatory views of the locking of the cam lobe portion.

Next, the supply of oil to the supply passage T is stopped by the oil control valve CV, so that the pin 26P is disengaged from the hole 15 and is housed in the hole 26 by the biasing force of the spring 15S as illustrated in FIG. 6A. Thus, the locking of the cam lobe portion 20 in the lift stop state is released.

Figure 6B:
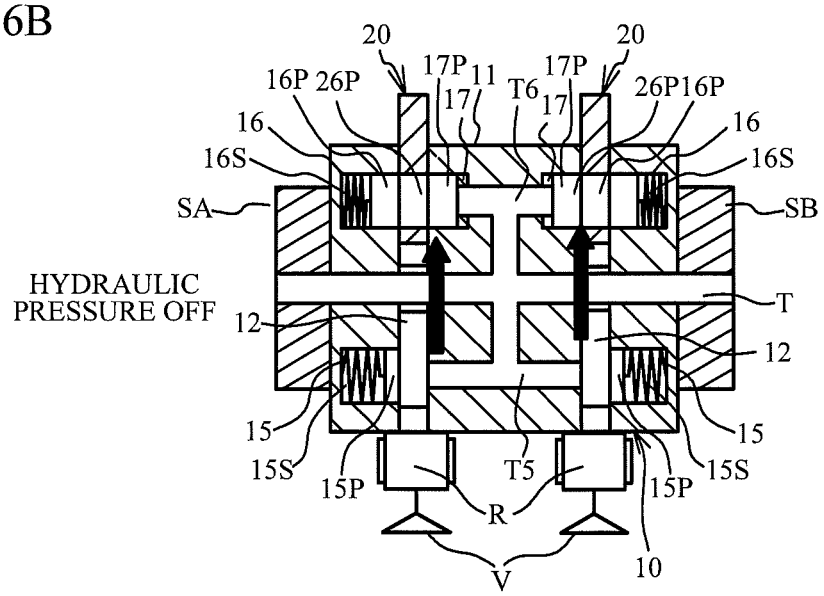

Subsequently, the cam lobe portion 20 is shifted to the lift state from the lift stop state by the biasing force of the spring 34S, as illustrated in FIG. 6B. Actually, while the cam lobe portion 20 does not come into contact with the rocker arm R, the cam lobe portion 20 is shifted to the lift state by the biasing force of the spring 34S. In the lift state, the pins 16P, 26P, and 17P are aligned in the axial direction, as described above.

In this state, as illustrated in FIG. 4A, the pin 16P is commonly inserted into the holes 16 and 26 by the biasing force of the spring 16S. Likewise, the pin 26P is commonly inserted into the holes 26 and 17. Thus, the cam lobe portion 20 is locked in the lift state. As described above, the cam lobe portion 20 is locked in the lift state and lift stop state. The hole 26, the pin 26P, the springs 15S and 16S, the holes 15 and 17, and the like is an example of a lock mechanism.

As illustrated FIGS. 1, 2, 3A, 3B, 4A, and 4B, the cam base portion 10 is connected to the camshaft S, and the camshaft S does not penetrate through the cam base portion 10. It is therefore possible to ensure an axial cross-sectional area of the cam base portion 10, thereby ensuring the strength of the cam base portion 10. Since the camshaft S does not penetrate through the cam base portion 10, the diameter of the camshaft S does not have to be made smaller. For this reason, the strength of the camshaft S is also ensured. All of the holes 15, 16, and 17 formed in the cam base portion 10, the hole 26 formed in the cam lobe portion 20, and the like extend in the axial direction. Thus, for example, as compared with a case of arranging a pin sliding in a hole extending in a direction intersecting with the axial direction, the axial cross-sectional area of the cam base portion 10 can be ensured. Thus, the strength of the cam unit CU is ensured.

As illustrated in FIGS. 3A and 3B, the free end of the cam lobe portion 20 is distant apart from the proximal end of the cam lobe portion 20 in the direction opposite to the rotational direction of the camshaft S. Herein, the proximal end side of the cam lobe portion 20 serves as a fulcrum of the swing by the support shaft 33. This facilitates the swing of the cam lobe portion 20 in the direction opposite to the rotational direction of the camshaft S in accordance with the reaction force of the rocker arm R. Also, in the state of releasing the locking, this facilitates the shift of the cam lobe portion 20 from the lift state to the lift stop state. Further, this reduces the reaction force that the cam lobe portion 20 receives from the rocker arm R when the cam lobe portion 20 is brought into the lift stop state, whereby the durability of the cam lobe portion 20 is ensured.

Furthermore, the cam base portion 10 supports the two cam lobe portions 20. Therefore, since the axial length of the cam base portion 10 is ensured, the strength is ensured. Moreover, since the cam base portion 10 is commonly used for the two cam lobe portions 20, the number of parts is reduced. Further, since the support shaft 33 commonly penetrates through the two cam lobe portions 20, the number of parts is also reduced.

Also, as illustrated in FIGS. 1 and 2, the springs 15S, 16S, 34S are arranged in the axial direction with respect to the cam lobe portion 20. For example, as compared with a case of arranging the spring 34S or the like to overlap the cam lobe portion 20 in the radial direction, it is possible to ensure the axial cross-sectional area of the cam lobe portion 20. It is therefore possible to ensure the strength of the cam lobe portion 20.

Further, as described above, since the recess portion 10H, in which the springs 34S are arranged, is provided at the position not to come into contact with the rocker arms R, this position is effectively used. The springs 34S are located at the position spaced apart from the portion of the cam base portion 10 that coming into contact with the rocker arm R, thereby ensuring the axial cross-sectional area of the portion of the cam base portion 10 that comes into contact with the rocker arm R. Thus, the strength of the cam base portion 10 is also secured.

As illustrated in FIG. 3A, the outlet of the path T5 is formed to open to the slit 12, and the outlet is spaced apart from the cam lobe portion 20 in the lift state. Therefore, in the lift state, oil is supplied to the supply path T, so it is possible to supply oil to the rocker arm R and the like via the slit 12 from the outlet of the path T5. Thus, it is possible to ensure lubrication of the cam unit CU and the rocker arms R. Further, even if a conventional cam shower mechanism is eliminated, the variable valve gear 1 according to the present embodiment can facilitate lubrication.

Figure 7:
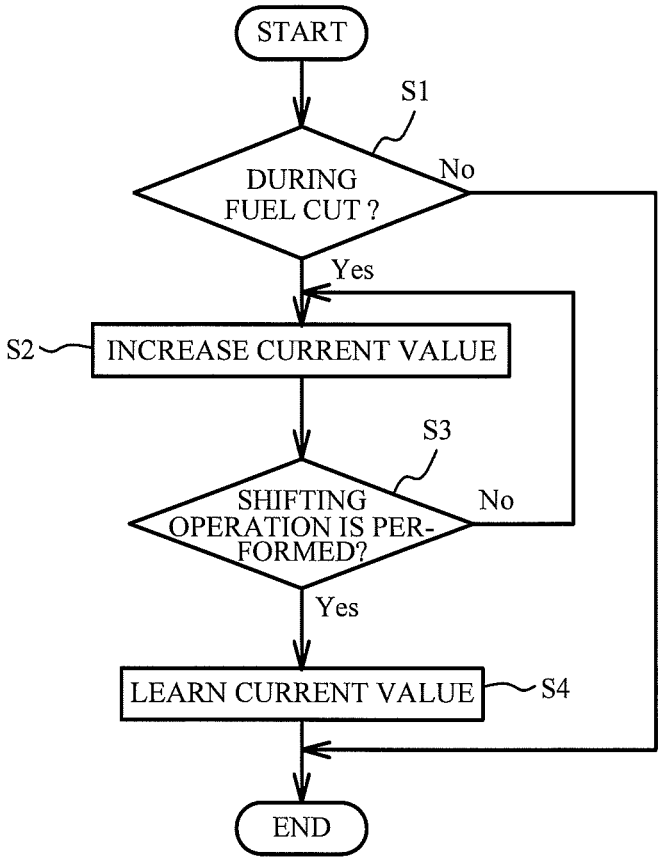
FIG. 7 is a flowchart of an example of learning control of an oil control valve performed by an ECU.

Next, a description will be given of the learning control of the oil control valve CV performed by the ECU 5. FIG. 7 is a flowchart of an example of the learning control of the oil control valve CV performed by the ECU 5. After the ignition of the internal combustion engine is turned ON, the ECU 5 determines whether or not the fuel cut is being performed in the internal combustion engine (step S1). When a negative determination is made, the control is finished. When a positive determination is made, the ECU 5 increases an current value applied to the oil control valve CV so as to start the supply of oil to the supply path T (step S2). Specifically, the duty ratio of the current applied to the oil control valve CV is gradually increased. The current value applied to the oil control valve CV is gradually increased. In addition, the oil control valve CV is capable of increasing the pressure of oil in the supply path T on the basis of the applied current value.

Then, on the basis of an increase in the pressure of oil in the supply path T, the ECU 5 determines whether or not the cam lobe portion 20 is shifted from the lift state to the lift stop state (step S3). Specifically, on the basis of a change in the intake air amount calculated based on an output value of the airflow meter, the ECU 5 performs the above determination. In the lift state, intake air is introduced into the combustion chamber in the internal combustion engine. In contrast, since the valve is not lifted in the lift stop state, intake air is not introduced into the combustion chamber and the intake air amount is reduced. This decrease in the intake air amount can be detected based on the output from the airflow meter, the ECU 5 can determine that the cam lobe portion 20 is shifted from the lift state to the lift stop state.

Subsequently, the ECU 5 learns the current value that is applied to the oil control valve CV at the time when the cam lobe portion 20 is shifted from the lift state to the lift stop state (step S4). Specifically, the ECU 5 stores this current value in the RAM. The current value applied to the oil control valve CV corresponds to the hydraulic pressure in the supply path T and the paths T5 and T6. Therefore, by learning the current value that is applied to the oil control valve CV at the time when the cam lobe portion 20 is shifted from the lift state to the lift stop state, it is possible to learn the current value when the cam lobe portion 20 is shifted from the lift state to the lift stop state. In such a way, the ECU 5 finishes the learning control. The reason that the learning control is performed during the fuel cut in this way is that the stop of the valve lifting does not greatly influence the driving state during the fuel cut.

A current value less than the current value learned in the above way is applied to the oil control valve CV, and oil is supplied to the supply passage T, thereby supplying oil from the outlet of the path T5 to the outside of the cam base portion 10 as much as possible without shifting the cam lobe portion 20 from the lift state to the lift stop state. This can sufficiently lubricate the rocker arms R, the cam unit CU, and the like. Additionally, there are individual differences in oil viscosity and in the spring 16S for locking the cam lobe portion 20 in the lift state. Therefore, even when there are individual differences, the learning of the current value applied to the oil control valve CV can use oil sufficiently for lubrication.

Figure 8A:
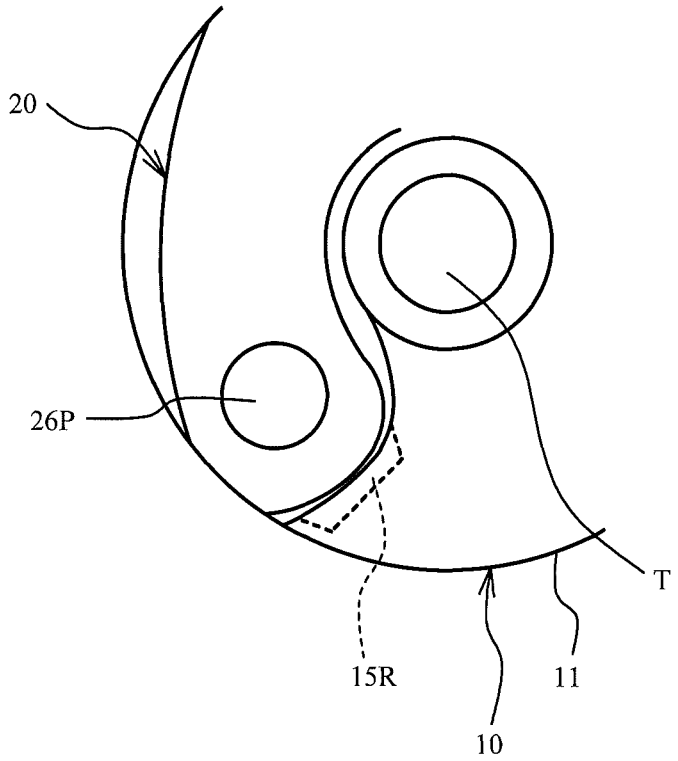
FIG. 8A is a partially enlarged view of FIG. 3B.
Figure 8B:
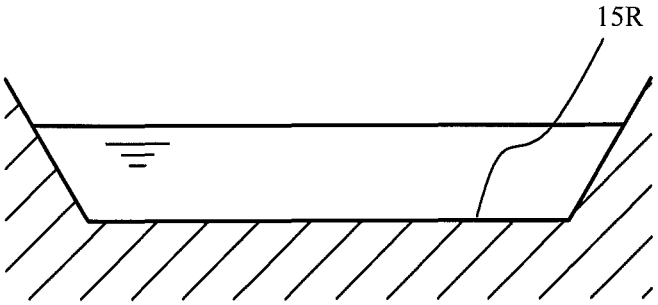
FIG. 8B is an explanatory view of a recess portion.
Figure 8C:
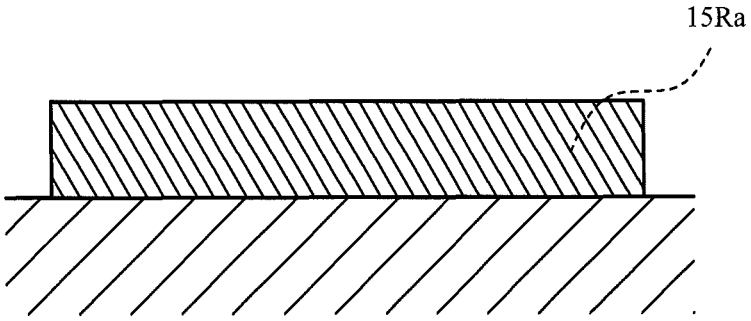
FIG. 8C is an explanatory view of a absorbing member.

FIG. 8A is a partially enlarged view of FIG. 3B. As illustrated in FIG. 8A, a recess portion 15R is formed at a position of the cam base portion 10 facing the free end of the cam lobe portion 20 in the lift stop state. The recess portion 15R is formed in the vicinity of the outlet of the path T5. The recess portion 15R retains a part of oil discharged from the outlet of the path T5 to the outside of the cam base portion 10. The recess portion 15R is an example of a retaining portion. As illustrated in FIG. 8B, the recess portion 15R has a recess shape capable of retaining oil. Thus, when the cam lobe portion 20 is shifted from the lift state to the lift stop state, the oil held in the recess portion 15R comes into contact with the free end of the cam lobe portion 20. Therefore, it is possible to absorb the impact when the cam lobe portion 20 is shifted to the lift stop state. It is thus possible to ensure the durability of the cam base portion 10 and the cam lobe portion 20.

In addition, as illustrated FIGS. 3A and 3B, the rotational direction of the cam unit CU is the clockwise direction. A bottom surface of the recess portion 15R is formed to face the rotational direction of the cam unit CU. Therefore, the inertial force is generated by the rotation of the cam unit CU, whereby the oil is held in the recess portion 15R.

Further, instead of the recess portion 15R, an absorbing member 15Ra may be attached to the position that comes into contact with the free end of the cam lobe portion 20 shifted from the lift state to the lift stop state. The absorbing member 15Ra has spongy structure capable of absorbing and retaining oil. The cam lobe portion 20 can also be buffered by using oil in this way. The absorbing member 15Ra is an example of a retaining portion.

Figure 9:
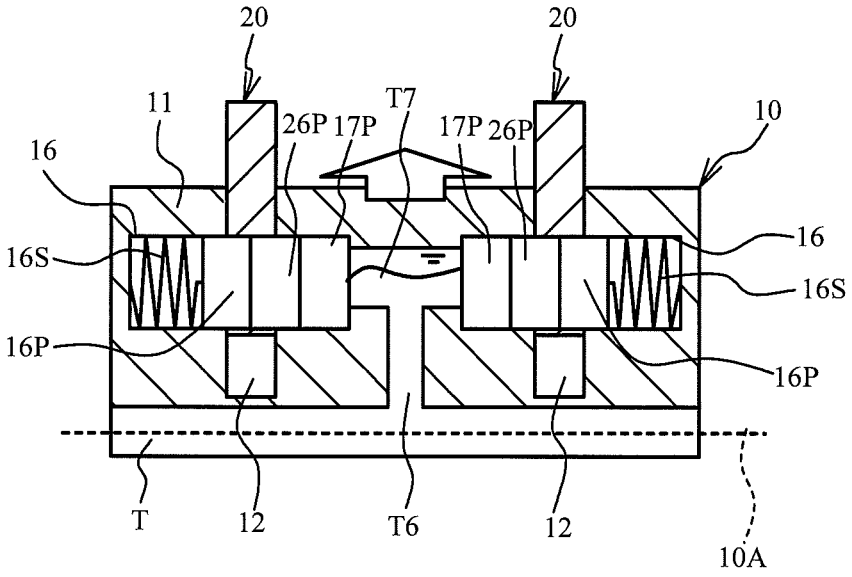
FIG. 9 is a partially enlarged view of FIG. 4A.

FIG. 9 is a partially enlarged view of FIG. 4A. As illustrated in FIG. 9, the path T6 includes a storage portion T7 formed and spaced apart from a rotational axis 10A of the cam base portion 10 in the radially outward direction. The storage portion T7 is an example of a storage chamber. The storage portion T7 extends coaxially with the hole 17 that houses the pin 17P. For example, when oil is stopped after being supplied to the supply passage T, the oil is stored in the storage portion T7 by the centrifugal force generated by the rotation of the cam base portion 10.

Therefore, when oil is supplied to the supply path T in the next time, the oil stored in the storage portion T7 can be re-used. It is thus possible to reduce the supply amount of oil supplied to the supply path T to shift the cam lobe portion 20 from the lift state to the lift stop state. Further, the centrifugal force exerting on the oil stored in the storage portion T7 increases as the rotational speed of the internal combustion engine increases. Therefore, even when the oil pressure is low, it is easier to shift the cam lobe portion 20 from the lift state to the lift stop state as the rotational speed of the internal combustion engine is higher.

Additionally, in the learning control described above, the ECU 5 may store the learned current value in association with the rotational speed of the internal combustion engine at the time when the current value is learned. In the normal driving state, the current value corresponding to the rotational speed of the internal combustion engine is applied to the oil control valve CV, whereby the lift state is maintained by the rotational speed and oil is used for lubrication.

While the exemplary embodiments of the present invention have been illustrated in detail, the present invention is not limited to the above-mentioned embodiments, and other embodiments, variations and modifications may be made without departing from the scope of the present invention.

In the present embodiment, the state where the cam lobe portion 20 does not project from the cam base portion 10 is explained as a second state. However, it is not limited. For example, the cam lobe portion 20 may swing between a first state of projecting from the base circle portion 11 of the cam base portion 10 and a second state of projecting the base circle portion 11 by the projecting amount in the second state smaller than in the first state.

In the lift state, the oil pressure may directly exert on the pin 26P without using the pin 17P. In addition, the springs 15S and 16S may directly bias the pin 26P without using the pins 15P and 16P.

In the above embodiment, the single cam base portion 10 is connected with the two cam lobe portions 20. However, it is not limited. For example, two cam base portions may be respectively connected with the two cam lobe portions 20.

The cam base portion 10 may be integrally formed with the camshaft, or may be joined therewith after being separately formed as described above in the present embodiment.

DESCRIPTION OF LETTERS OR NUMERALS

1 variable valve gear
5 ECU (control unit)
S camshaft
CV oil control valve
10 cam base portion
20 cam lobe portion
26 pin (locking member)
34S spring (biasing member)
15S spring (second spring)
16S spring (first spring)
17 hole (first locking hole)
15 hole (second locking hole)
T6 path (first path)
T5 path (second path)

The invention claimed is:

1. A variable valve gear for an internal combustion engine, comprising:

a cam base portion integrally or separately provided in a camshaft, and immovably fixed to the camshaft;

a cam lobe portion connected to the cam base portion so as to swing and shift between a first state where the cam lobe portion is positioned to project from an outer circumference of the base portion and a second state where the cam lobe portion is positioned to be lower than the cam base portion in the first state;

a lock mechanism configured to lock the cam lobe portion in the first and second state, the lock mechanism including a locking member, a first locking hole, a second locking hole, a first spring, a second spring, a first path, and a second path;

a biasing member configured to bias the cam lobe portion to be shifted to the first state, to such an extent that the cam lobe portion is shifted to the second state by reaction force from a cam follower when the locking mechanism is unlocked;

a locking member held in a holding hole, of the cam lobe portion, extending in an axial direction of the camshaft;

a first locking hole formed in the cam base portion, and arranged in the axial direction in the first state;

a second locking hole formed in the cam base portion, and arranged in the axial direction in the second state;

a first spring biasing the locking member to be inserted into the first locking hole in the first state;

a second spring biasing the locking member to recede from the second locking hole in the second state;

a first path formed in the cam base portion, and is configured to exert a hydraulic pressure on the locking member to be disengaged from the first locking hole in the first state; and a second path formed in the cam base portion, and is configured to exert a hydraulic pressure on the locking member to be inserted into the second locking hole in the second state.

2. The variable valve gear for the internal combustion engine of claim 1, wherein the second path comprises an outlet that is spaced apart from the cam lobe portion in the first state, and that discharges oil to an outside of the cam base portion.

3. The variable valve gear for the internal combustion engine of claim 1, comprising:

a hydraulic control valve adjusting a hydraulic pressure to be supplied to the first and second paths; and a control unit configured to learn a hydraulic pressure when the first state is shifted to the second state.

4. The variable valve gear for the internal combustion engine of claim 3, wherein the control unit performs control to learn a hydraulic pressure while fuel cut is performed in the internal combustion engine.

5. The variable valve gear for the internal combustion engine of claim 1, wherein the cam base portion comprises a retaining portion that retains oil in contact with the cam lobe portion in the second state.

6. The variable valve gear for the internal combustion engine of claim 1, wherein the cam lobe portion comprises:

a proximal end portion swingably connected to the cam base portion; and a free end portion spaced apart from the proximal end portion in a direction opposite to a rotational direction of the camshaft.

7. The variable valve gear for the internal combustion engine of claim 1, wherein the biasing member is arranged in an axial direction of the camshaft with respect to the cam lobe portion.

8. The variable valve gear for the internal combustion engine of claim 1, wherein:

the cam lobe portion comprises first and second cam lobe portions arranged in an axial direction of the camshaft; and the cam base portion supports the first and second cam lobe portions.

* * * * *